United States Patent [19]

Cooke et al.

[11] 4,071,379

[45] Jan. 31, 1978

[54] PHOSPHATING METHOD

[75] Inventors: Brian Alfred Cooke, Knotty Green; Michael Brock, Reading, both of England

[73] Assignee: Imperial Chemical Industries Limited, Great Britain

[21] Appl. No.: 678,426

[22] Filed: Apr. 19, 1976

[30] Foreign Application Priority Data

Jan. 28, 1976 United Kingdom ..... 3288/76

[51] Int. Cl.[2] ..... C23F 7/10

[52] U.S. Cl. ..... 148/6.15 Z; 148/31.5

[58] Field of Search ..... 148/6.15 Z, 31.5

[56] References Cited

U.S. PATENT DOCUMENTS

| | | | |
|---|---|---|---|
| 2,326,309 | 8/1943 | Romig | 148/6.15 Z |
| 3,333,988 | 8/1967 | Douty et al. | 148/6.15 Z |
| 3,401,065 | 9/1968 | Steinbrecher et al. | 148/6.15 Z |
| 3,607,453 | 9/1971 | Engesser et al. | 148/6.15 Z |
| 3,619,300 | 11/1971 | Heller et al. | 148/6.15 Z |
| 3,850,700 | 11/1974 | Heller | 148/6.15 Z |

FOREIGN PATENT DOCUMENTS

| | | | |
|---|---|---|---|
| 110,060 | 12/1974 | Germany | 148/6.15 Z |

*Primary Examiner*—Ralph S. Kendall

*Attorney, Agent, or Firm*—Cushman, Darby & Cushman

[57] ABSTRACT

In a continuous process of phosphating ferrous metal surfaces using an acidic zinc phosphate solution comprising chlorate and optionally nitrate ions, ferrous ion is maintained at low concentration by controlled addition of a rapid acting oxidant, for example nitrite ion.

7 Claims, No Drawings

PHOSPHATING METHOD

This invention relates to a process of applying a zinc phosphate coating to a ferrous metal substrate.

It is well known that a satisfactory fine-grain zinc phosphate coating can be obtained on a ferrous substrate by treating the substrate with an acidic solution of zinc phosphate which also contains chlorate ions or both chlorate and nitrate ions as depolarisers for the principal process of coating formation. When employed on a continuous basis, this process suffers from the accumulation in the working solution of iron as ferrous ion which is liberated in the process reaction but which is only slowly oxidised to ferric ion by chlorate or chlorate/nitrate ions. Two disadvantages of this accumulation of ferrous ion are recognised in the art: (1) the quality of the coating may be adversely affected, and (2) during any interruption of continuous working, for example due to inadvertent or overnight stoppage, the slow oxidation of ferrous ion and the precipitation of the thus formed ferric ion as ferric phosphate causes an uncompensated rise in the acidity of the working solution with a resultant adverse effect on its coating performance when operation is resumed.

It has previously been proposed to alleviate the above disadvantages by, for example, raising the temperature of the working solution or by adding a catalyst to accelerate the rate at which ferrous ion is oxidised by the combination of chlorate and nitrate ions. A rise in temperature of the working solution is costly to produce and to maintain and may have an adverse effect on the coating characteristics of the working solution and its general performance, particularly in a spray process. Catalytic means of accelerating the rate of oxidation of ferrous ion may alleviate the problems mentioned above but they by no means eliminate them.

We have now found that much improved results are obtained, for example in respect of uniformity of coating characteristics, by employing a rapid-acting secondary oxidant for ferrous ion, the proportion of said oxidant being chosen such that the oxidation of ferrous ion is accomplished but that the oxidant itself does not accumulate to such an extent that it is able to take a substantial part as a depolariser in the principal process of coating formation, i.e., its concentration as a depolariser is not allowed to reach those levels in the working solution, e.g. of 1 millimole liter and above, at which is is known from the prior art that such rapid-acting oxidants may function as primary oxidants.

According to the invention, therefore, we provide a continuous process of producing a phosphate coating on a ferrous metal substrate which comprises treating the ferrous metal substrate with an acidic solution of zinc phosphate in the presence of chlorate ions, optionally in the absence of nitrate ions also, and adding to the solution as coating proceeds a proportion of a rapid-acting secondary oxidant for ferrous ion (as herein defined) which is sufficient to maintain the concentration of ferrous ion at less than 112 parts per million (ppm) parts of the solution, there being present in the working solution when in the steady state a proportion of the said secondary oxidant of from 0 to 0.6 millimoles per liter of the solution.

Preferably the concentration of ferrous ion is maintained at less than 56 ppm parts of the solution.

Preferably the acidic solution contains 0.5–5.0g/l of zinc as Zn, 3–50g/l of phosphate as $PO_4$, 0.5–5.0g/l of chlorate as $ClO_3$, and 0–15g/l of nitrate as $NO_3$. Preferably the total acid content of the solution is not greater than 30 points and the ratio of free acid to total acid is in the range 0.02–0.1 (Pointage = mls of N/10 sodium hydroxide required to titrate a 10ml sample of the solution using phenolphthalein as indicator for total acid and methyl orange for free acid). Preferably the temperature of the solution does not exceed 65° C.

By the term "secondary oxidant" we mean an oxidant the function of which in the process is solely to oxidise the ferrous ion without taking part to any significant extent in the primary coating formation process. Any rapid acting oxidant will fulfill the function of the secondary oxidant in the present invention. By a rapid acting oxidant we mean an oxidant which, when added to an acidic zinc phosphate solution containing ferrous ion, will within 10 minutes at the normal operating temperature of the solution reduce the concentration of ferrous ion by at least one half of the extent theoretically possible.

Suitable rapid acting secondary oxidants include alkali metal nitrites or ammonium nitrite, hydrogen peroxide, compounds containing combined hydrogen peroxide which liberate hydrogen peroxide under acidic conditions, sodium hypochlorite, peroxydiacid salts such as perphosphates and perborates. Particularly suitable oxidants are sodium nitrite and hydrogen peroxide.

By the "steady state" of the working solution we mean a state in which the composition of the solution does not vary systematically with time of operation, the criterion of systematic variation being established over periods of the order of several hours.

It is conventional practice to replenish a working solution of acidic zinc phosphate with an acidic replenishment concentrate containing zinc phosphate and to add an alkaline solution (the "toner") having as one of its functions the neutralisation of the excess acidity which is present in the replenishment concentrate over that which is required in the bath. Commonly the alkaline "toner" comprises sodium nitrite which functions both as an alkali (relative to the phosphating solution) and as a supply of oxidant to the process. The acidic concentrate is added at a rate sufficient to maintain the zinc and/or phosphate content of the solution at that desired and the sodium nitrite is fed independently at a rate which is sufficient to maintain an effective level of nitrite ion in the solution, commonly of the order of at least 2 millimoles/liter.

Because of rapid-acting oxidant required for the purpose of the present invention supplies only part of the total oxidant requirement of the process, the quantity required to be fed is smaller than in those typical processes of the prior art in which sodium nitrite is the sole additive apart from the zinc phosphate concentrate. But a substantial quantity of an alkaline substance, e.g. sodium hydroxide, is generally required to ensure the neutralisation of excess free acidity in the zinc phosphate-containing concentrate. It therefore follows that to achieve the purpose of the present invention, it will in general be necessary to feed, in addition to the zinc phosphate-containing concentrate, both an alkaline toner and the required amount of rapid-acting oxidant. The latter two may or may not be combined in a single stream, depending on their compatibility. If they are incompatible, the bath would be required to be replenished by 2 streams in addition to the zinc phosphating concentrate, but if compatible only one stream would be needed. In either case, the two or more replenishment streams are required to be delivered to the bath in a fixed ratio of feed rates, e.g. by volume, and can for example be delivered by multiplepumps driven off a common shaft or by pumps actuated by a common power supply. Such an arrangement represents an advance on the typical processes of prior art in which the bath is fed from two or more sources at rates requiring independent adjustment. The feeding arrangement possible in carrying out the present invention may, however, consist of separate pumps having a common drive, the only adjustment required to meet the possibly fluctuating needs of the operation being an adjustment of the speed of the drive or the proportion of time during which the drive is actuated, (e.g. by altering the mark/space ratio on a timing device). Such adjustments would ordinarily be carried out in response to alterations in bath composition as determined by manual or automatic titration of a parameter reflecting the strength of the bath solution, e.g. total acidity (pointage).

The process of the present invention lends itself to automatic control of bath solution composition by a device which senses its electrolytic conductivity, provided are met the conditions specified in our U.S. Ser. No. 678,439, filed Apr. 19, 1976 based on British Application No. 16799/75.

In this copending Application we have described a continuous method of applying a zinc phosphate coating to a metal surface, for example when coating a series of work pieces or a continuous sheet of metal, of the type wherein:

1. the metal surface is treated with an acidic solution which comprises zinc, phosphate and alkali metal ions,
2. the said solution is replenished as coating proceeds by appropriate additions of a material (a) comprising zinc and phosphate ions and another material (b) comprising alkali metal ions, (b) having an alkaline reaction relative to (a), and
3. the composition of the solution when in the steady state is at an optimum which can be maintained as coating proceeds by additions of (a) and (b) in a defined ratio of addition rates.

We have described how the composition of the acidic solution can be automatically maintained by first bringing the solution to that composition which is characteristic of the steady state and thereafter making additions of (a) and (b) to the solution so as to hold constant its electrolytic conductivity at a given temperature, the additions of (a) and (b) in response to any change in conductivity being made in the said definite ratio.

The invention is illustrated by the following Examples in which parts and percentages are by weight:

EXAMPLE 1

This example describes the coating of steel panels with zinc phosphate according to the process of the present invention and using a phosphating solution which comprised zinc, phosphate, chlorate, nitrate and sodium ions. The optimum composition of the solution at the steady state was determined by analysis of prior phosphating baths of this type which were known to be in the steady state and which gave satisfactory coatings at that steady state. The optimum composition was maintained by the process described in our copending U.S. Ser. No. 678,439, filed Apr. 19, 1976 in response to changes in the conductivity of the solution.

Replenishment materials (a) and (b) according to the invention were as follows:

a. Zinc Phosphate/Nitrate Chlorate
Zinc Oxide: 122 parts
59% nitric acid: 102 parts
81% phosphoric acid: 338 parts
Sodium Chlorate: 79 parts
were dissolved in water to give a total weight of 1,000 parts.

b. Sodium/Oxidant ("Toner")
Sodium Hydroxide: 84 parts
Sodium Nitrite: 25 parts
were dissolved in water to give a total weight of 1,000 parts.

An initial acidic phosphating solution was prepared by mixing 102 parts of the solution of replenishement material (a) with 50 parts of an intimately mixed solid starter powder (consisting of 145 parts sodium dihydrogen phosphate, 67 parts sodium chlorate, 213 parts sodium nitrate and 76 parts sodium chloride) the mixture being dissolved in further water to a total weight of 5,000 parts. This initial solution (also containing a small proportion of sodium carbonate) had a total acid pointage of 10.5 and a free acid pointage of 0.5 (Pointage = mls of N/10 sodium hydroxide required to titrate a 10 ml sample of the solution using methyl orange as indicator for free acid and phenolphthalein as indicator for total acid). The conductivity of the solution was $2.32 \times 10^{-2}$ $ohms^{-1}cm^{-1}$ at 50° C.

Rolled mild steel panels measuring 30.5 cm × 22.9 cm × 0.9 mm thick were treated in the above solution at a temperature of 50° C and at a rate of 4 panels/hour. The rate of metal treatment was thus 0.112 sq.m/liter of bath/hour and at this rate of treatment after 12 hours total running there had been a complete turnover of the zinc content of the bath.

Coating was continued for a total time of 24 hours but in four separate periods of 6 hours each.

The replenishment of the phosphating solution was effected by simultaneous additions of the above solutions (a) and (b) in a constant ratio of feed rates, 0.43g of (b) being added for every 1g of (a), in response to changes in the electrical conductivity of the phosphating solution. The electrical conductivity was measured by conventional means there being provided means for preventing insulation of the conductivity sensor by precipitated materials. 50 parts by volume portions of the bath were rejected at ½ hour intervals and the original volume restored in order to simulate the carry-over in an operational plant. No additions were made to the bath other than those mentioned. At no time did the concentration of ferrous ion in the phosphating solution exceed 56 ppm and the concentration of nitrite ion did not exceed 0.3 millimoles liter.

A high standard of coating was maintained throughout the experiment, the coating weight being approximately 1.9g/sq. m. The final free acid pointage was 0.5, the final total acid pointage 10.4 and the conductivity $2.23 \times 10^{-2} ohm^{-1}cm^{-1}$. The analysis of the bath remained substantially as it was at the beginning of the experiment when it was as follows:

2g/l of zinc as Zn; 7.7g/l of phosphate as $PO_4$; 2.3g/l of chlorate as $ClO_3$; 4.3g/l of nitrate as $NO_3$3.2g/l of sodium as Na; and 0.93g/l of chloride as Cl. The phosphated panels were subsequently satisfactorily painted by electrodeposition or by spraying and the finished panels were consistent in appearance and corrosion resistance.

EXAMPLE 2

This Example describes the coating of steel articles on a plant scale by the spray application of a working solution which comprised zinc, phosphate, chlorate, nitrate and sodium ions.

A phosphating tank of 5,400 liters capacity was charged with an initial ("start-up") phosphating solution prepared by mixing 102 parts of a replenishment concentrate (a) which was compounded from the ingredients:

Zinc oxide: 122 parts
59% nitric acid: 102 parts
81% phophoric acid: 338 parts
Sodium chlorate: 79 parts these ingredients being dissolved in water to give a total weight of 1000 parts, and 50 parts of an intimately mixed solid starter powder consisting of:

Sodium dihydrogen phosphate: 145 parts
Sodium chlorate: 67 parts
Sodium nitrate: 213 parts
Sodium chloride: 76 parts the mixture being dissolved in further water to a total weight of 5,000 parts. The initial solution had a total acid pointage of 10.5 and a free acid pointage of 0.5.

Steel articles were sprayed with the solution prepared as described above at a temperature of 110°–115° F to give a coating weight on the steel of 1.3g/square meter. The replenishment concentrate (a) described above and a toner concentrate (b), which comprised:

Sodium hydroxide: 44 parts
Sodium nitrite: 44 parts these ingredients being dissolved in water to give a total weight of 1,000 parts, were fed concurrently so that they were added to the working solution in equal volumes. Additions were initiated by an automatic controller so as to hold the conductivity of the solution constant as described in our copending U.S. Ser. No. 678,439.

The chemical analysis of the solution was maintained substantially constant at: Zinc as Zn, 2.00g/l; phosphate as $Po_4$, 7.04g/l; chlorate as $ClO_3$, 2.10g/l and nitrate as $No_3$, 3.95g/l. The concentration of nitrite ion in the solution under these conditions was substantially zero and that of ferrous ion was less than 20 ppm.

The process was continued for 12 hours a day over 20 working days and a total of $1.5 \times 10^5$ square meters of steel was coated. It was found by scanning electron microscopy that the deposited phosphate coating completely covered the steel and was of fine grain. A coating of paint, applied subsequently by electrodeposition, gave excellent performance when subjected to accelerated tests for corrosion resistance and mechanical properties.

We claim:

1. In a continuous process of producing a phosphate coating on a ferrous metal substrate which comprises treating the ferrous metal substrate with an acidic solution of zinc phosphate in the presence of chlorate ions, and optionally nitrate ions, the improvement which consists in adding to the solution as coating proceeds a proportion of a rapid-acting secondary oxidant for ferrous ion which is sufficient to maintain the concentration of ferrous ion at less than 112 parts per million of the solution and which is selected from alkali metal nitrites, ammonium nitrite, hydrogen peroxide, compounds containing combined hydrogen peroxide which liberate hydrogen peroxide under acid conditions, sodium hypochlorite and peroxydiacid salts, there being present in the solution when in the steady state a proportion of the secondary oxidant of from 0 to 0.6 millimoles per liter of the solution.

2. A method according to claim 1 wherein the concentration of ferrous ion is maintained at less than 56 parts per million parts of the solution.

3. A method according to claim 1 wherein the secondary oxidant is an alkali metal nitrite, ammonium nitrite or hydrogen peroxide.

4. A method according to claim 1 wherein the acidic phosphating solution comprises 0.5–5.0g/l of zinc as Zn, 3–50g/l of phosphate as $PO_4$, 0.5–5.0g/l of chlorate as $ClO_3$ and 0–15g/l of nitrate as $NO_3$.

5. A method according to claim 1 wherein the acidic phosphating solution has a total acid content of not greater than 30 points and a ratio of free acid to total acid in the range 0.02–0.1.

6. A method according to claim 1 wherein the metal surface is treated by spray application of the acidic phosphating solution.

7. A metal surface having a zinc phosphate coating applied by a method according to claim 1.

* * * * *